US005862749A

United States Patent [19]

Lizarazu

[11] Patent Number: 5,862,749

[45] Date of Patent: Jan. 26, 1999

[54] MACHINE FOR ENGRAVING BY IMPACT OR SCRATCHING

[76] Inventor: Pio Echeverria Lizarazu, Barrio Carabel Txiki, s/n - 20120 Hernani, Guipuzcoa, Spain

[21] Appl. No.: 922,354

[22] Filed: Sep. 3, 1997

[30] Foreign Application Priority Data

Nov. 7, 1996 [ES] Spain ..... 9602348

[51] Int. Cl.[6] ..... B31F 1/07

[52] U.S. Cl. ..... 101/3.1; 409/191

[58] Field of Search ..... 101/3.1, 26; 409/191, 409/190, 201, 211; 83/614, 646, 647

[56] References Cited

U.S. PATENT DOCUMENTS 4,089,262 5/1978 Sopora ..... 101/4
4,834,595 5/1989 Cacciotti ..... 419/80
5,346,343 9/1994 Babel ..... 409/201
5,493,965 2/1996 Lizarazu ..... 101/3.1

*Primary Examiner*—Edgar Burr
*Assistant Examiner*—Dave A. Ghatt
*Attorney, Agent, or Firm*—Blank Rome Comisky & McCauley LLP

[57] ABSTRACT

Machine for engraving by impact or scratching, which comprises an engraving device (10) assembled on a crosshead (9), capable of travel along a rail (8) parallel to the surface to be engraved. The rail (8) is assembled on a rocking support (5–6), which rotates around an axis (7) which is parallel to the rail (8) and coincides with the axis of the section of a drive belt (14) to which the crosshead (9) is related to.

3 Claims, 2 Drawing Sheets

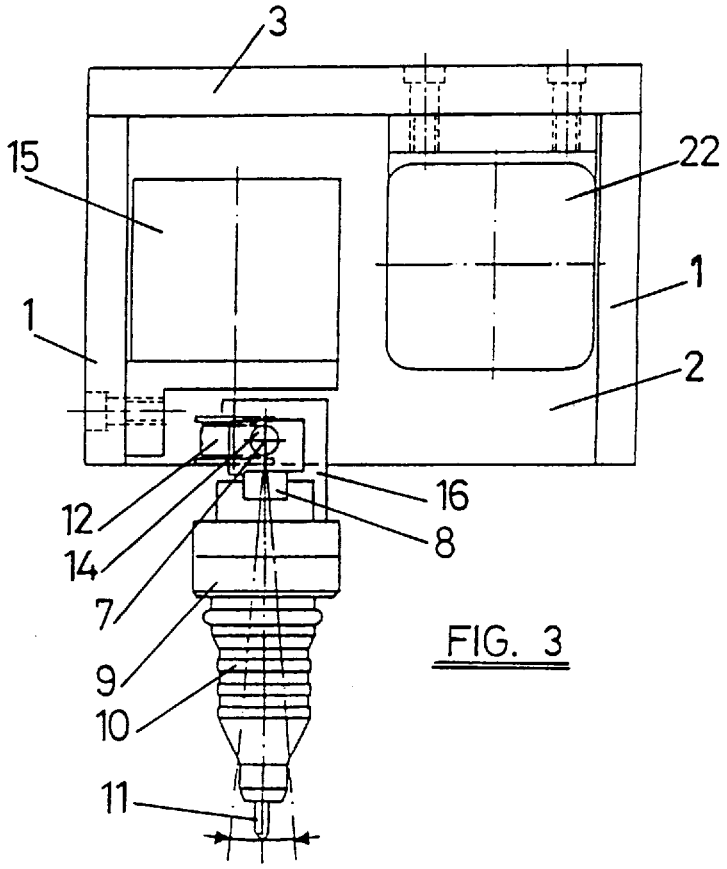
FIG. 3
FIG. 4
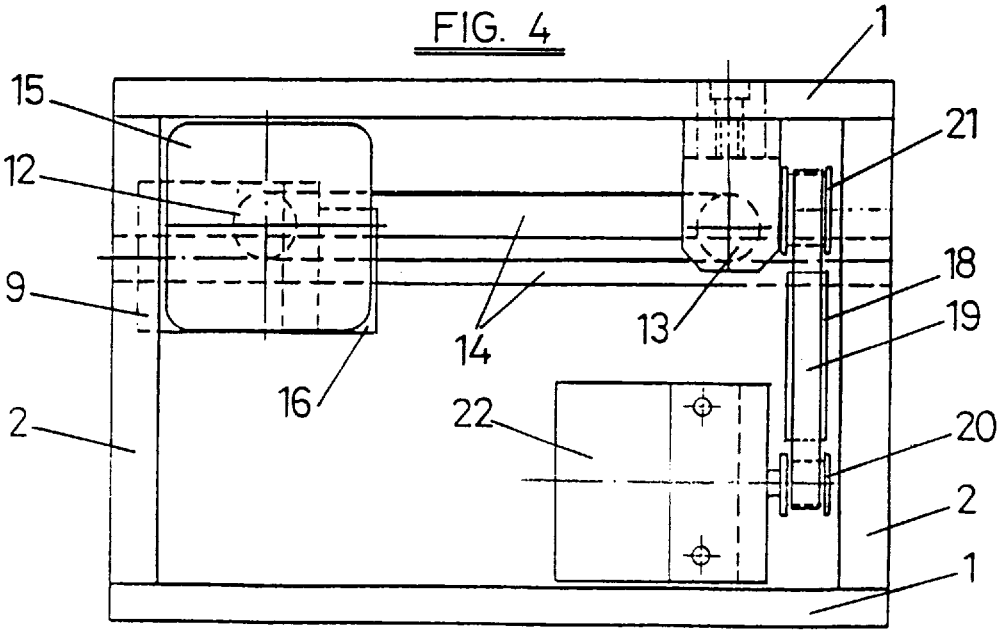

MACHINE FOR ENGRAVING BY IMPACT OR SCRATCHING

The present invention relates to a machine for engraving by impact or scratching, especially intended for engraving signs and/or characters on surfaces of metallic and plastic material parts, etc., and is of the type which comprises a pneumatic or solenoid engraving device which is equipped with a percussion point capable of impacting on the surface to be engraved, and when moving with a preset trajectory, the successive point deformations produced with each impact, engrave the different figures. The same may also work by scratching on the surface, for which a pressure is maintained on the point over the part to be engraved.

Said machines are widely used in an infinity of industrial activities, for engraving on parts, signs or characters which make up a code or identification reference or which is supplier of specific information.

More specifically, the machine of the invention is of the type which comprises a crosshead which is carrier of the engraving device and which may travel in a controlled manner along the length of an axis which is parallel to the surface to be engraved.

By means of German Patent No. 2423424, a machine of the type described is already known, in which the axis over which the crosshead, carrier of the percussion device is assembled, is constituted in continuous manner. The rotation in one direction or another of said worm, causes the lineal travel of the crosshead. Additionally, the crosshead may rotate in one or other direction at a certain angle over the actual worm. The constitution described requires activating mechanisms which are considerably complicated.

European Patent 371896 describes a machine of the previously indicated type, in which the axis over which the crosshead, carrier of the percussion device is assembled, consists of a circular cross sectional rod over which the crosshead may travel in longitudinal direction and rotate in one direction or another at a certain angle.

In the two previously indicated cases, the crosshead of the engraving device is rotational as regards the arbor or rod which constitutes the axis along the length of which, said crosshead may travel.

An engraving machine is known from Spanish Patent No. 9401318, in which the crosshead, carrier of the engraving device may travel, along an axis in the same manner as in the previous cases. Said axis is constituted by a guiding rod with polygonal cross section, which may rotate freely on its axis. In this case, the crosshead can only travel lineally on the guiding rod, without rotating on the same, said rod being the one which can rotate on its axis.

In all the described cases, the crosshead, carrier of the engraving device may slide along an arbor, rod or rail and rotate around the axis of the same at a certain angle in both directions, thus obtaining said second movement by the possibility of rotation of the crosshead on the arbor or rod or else by the rotation of the rail on its own axis.

The object of the invention is a machine of the type already described, which comprises a pneumatic or solenoid engraving device which is installed on a crosshead which travels in controlled manner along a guiding rail, parallel to the surface to be marked, said crosshead of which, may rotate around an axis, parallel to said surface and is related to a drive belt, parallel to the same surface, to cause its travel along the length of the rail. The machine of the invention is characterized in that said rail is installed in a rocking support, which is rotational on an axis parallel to the rail, and coincident with the section of the drive belt to which the crosshead, carrier of the engraving device is related.

In this manner, the rotational axis of the crosshead, carrier of the engraving device and the guide rod along which the crosshead travels, are not coincident, remaining in parallel position, and separated from each other, a certain distance.

With the described constitution, on rotation of the crosshead, carrier of the engraving device, in one direction or another, a certain torque shall be caused in the section of the drive belt to which said crosshead is related. However, when the rotation axis of the crosshead coincides with said section of the belt, the torque caused shall be minimum, without producing significant alterations, all the above, considering also, the relative reduced amplitude in the rotation of the crosshead, in one direction or another.

The characteristics of the invention described, permit the considerable simplification of the constitution of the machine.

The characteristics described, as well as others pertaining to the invention and the advantages derived from the same, are described in greater clarity in the following description, drawn up with reference to the enclosed drawings, in which an example of a non limitative embodiment is shown.

In the drawings:

FIG. 3 is a left hand side elevational view of the machine of FIG. 1, with the wall of the same side deleted.

FIG. 4 is an upper plan view of the machine, with the cover or upper base of the casing deleted.

Figure 1:
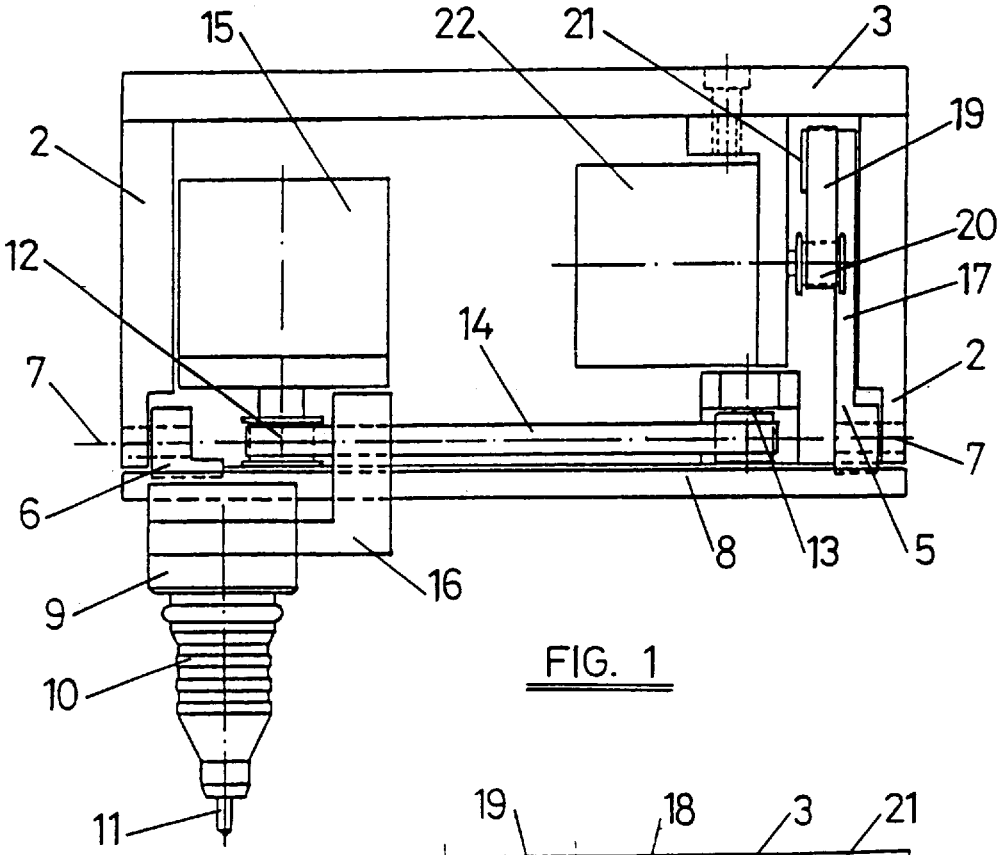
FIG. 1 is a front elevational view of a machine constituted according to the invention, with the front wall of the casing deleted.

The machine represented in the drawings includes a casing or frame, which in an example, represented in the drawings, is comprised of longitudinal walls 1, transversal walls 2 and a cover or upper base 3. Within said frame, between the transversal walls 2, a rocking support is assembled, constitued by two elbowed arms 5 and 6, one of its branches aligned, whilst through the other branch, they are hinged on the transversal walls 2 of the frame by means of axis 7, aligned, to define the hinge axis of the support.

A rail 8 is attached to the aligned branches of arms 5 and 6, on which a crosshead 9, capable of sliding along the same is assembled, which is carrier of an engraving device 10, pneumatic or by solenoid, carrier of a percussion point 11.

Inside the frame or casing, two pulleys 12 and 13 are additionally assembled, belt 14 running between the same. The pulley 12 is activated by a motor 15, also attached inside the frame or casing. The belt 14 is parallel to the guide rail 8, crosshead 9 being related with one of the sections of belt 14 through an arm 16, which is fixed to said section of the belt by means of any system.

Pulleys 12 and 13 are arranged in such a manner, that the section of belt 14 to which arm 16 is related, coincides with the hinge axis 7 of the support, made up of elbowed arms 5 and 6, such as may be better observed from FIG. 1.

Figure 2:
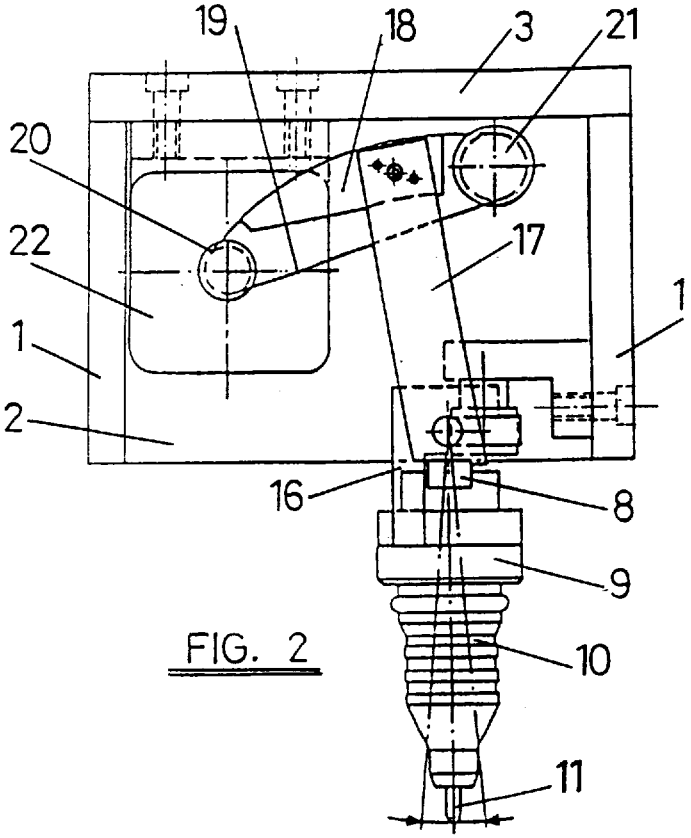
FIG. 2 is a right hand side elevational view of the machine, with the wall of the same side deleted.

The branch of arm 5, articulated on the wall of frame 2, extends into a section 17 which is carrier, as may be better observed in FIG. 2, of a section of toothed pulleys 18 which mesh with a toothed belt 19 assembled between pulleys 20 and 21, the first of which is activated by a motor 22 also assembled inside the frame or casing.

By means of motor 22, rotating in one direction. or another, through the toothed belt 19 and inside section 18, FIG. 2, arm 5 is activated, causing the rocking of the support comprised of arms 5 and 6, driving the guide rail 8 and with the same, the crosshead 9 and engraving device 10. FIGS. 2 and 3 show the amplitude of the total rotational angle of the engraving device 10 and percussion point 11 by means of the described movement. Said rotation shall produce, through arm 16, FIG. 1, a slight torque on the section of the elastic drive belt 14, said torque being of a practically insignificant quantity, due to which, it shall practically not affect the stress and stability of said belt By means of motor 15 is obtained, through belt 14, the longitudinal travel of arm 16 which drives the crosshead 9 along the guide rail 8.

So as to engrave a determined surface, the machine shall be placed in such a manner that the guide rail 8 is parallel to the surface to be engraved. By subsequently combining the travel of crosshead 9 along the rail 8, by activation of motor 15, with the rotation of the engraving device 10 around axis 7, by means of motor 22, the percussion point 11 may act on the surface to be engraved.

As has been previously indicated, arm 16 may be attached or made solid with the section of belt 14 by means of any system. Rail 8 may also present any section to facilitate the coupling of the crosshead 9 and its travel along said rail.

The travel of crosshead 9 along rail 8 is performed in rigid manner, without movement of the activating and transmission devices, motor 15 and belt 14, and without requiring any device or moveable guide to compensate the transversal travels.

On the other hand, due to the coincidence of the hinge axis 7 with the axis of the section of belt 14 to which arm 16 is connected, a simple minimum torque of said belt section shall be produced by the rocking of the engraving device 10, without travel of the same, which permits the same to work mechanically in optimum manner, thus ensuring an efficient operation.

I claim:

1. A machine for engraving a surface comprising:

a frame, a drive motor stationarily mounted with respect to the frame, a crosshead, a guide rail, a drive belt driven by the drive motor, an engraving device mounted on the crosshead, the crosshead mounted for controlled travel along the guide rail and driven by the drive belt parallel to the surface to be engraved, the crosshead being rotatable relative to the frame about an axis parallel to a surface to be engraved, and the guide rail mounted on rocking supports, said guide rail rotatable about the axis parallel to the surface to be engraved.

2. A machine as in claim 1, wherein the rocking supports comprise two parallel arms between which the guide rail is attached, the arms mounted on the frame and rocking about a rocking axis, and an angular activation mechanism engaging one of the arms.

3. A machine as in claim 2, wherein the angular activation mechanism comprises a section of a toothed pulley formed in one of the arms and meshing with a toothed belt trained about two pulleys, one of said pulleys driven by an activation motor.

* * * * *